US008528894B2

(12) United States Patent
Kotaka et al.

(10) Patent No.: US 8,528,894 B2
(45) Date of Patent: Sep. 10, 2013

(54) METHOD OF DETECTING SHEET IN TRANSPORT DEVICE, TRANSPORT DEVICE, IMAGE READING DEVICE, AND IMAGE FORMING APPARATUS

(75) Inventors: Toshikazu Kotaka, Shiojiri (JP); Yosaku Tamura, Matsumoto (JP); Seiji Kawabata, Matsumoto (JP); Kensuke Tamai, Shiojiri (JP); Hidetoshi Kodama, Matsumoto (JP); Soichiro Kii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 443 days.

(21) Appl. No.: 12/533,428

(22) Filed: Jul. 31, 2009

(65) Prior Publication Data

US 2010/0025912 A1 Feb. 4, 2010

(30) Foreign Application Priority Data

Aug. 1, 2008 (JP) ..... 2008-199810

(51) Int. Cl.
*B65H 7/08* (2006.01)

(52) U.S. Cl.
USPC ..... 271/110; 271/25; 271/31; 271/38; 271/130

(58) Field of Classification Search
USPC ..... 271/25, 31, 38, 130, 110, 111
See application file for complete search history.

(56) References Cited

U.S. PATENT DOCUMENTS

| | | | | |
|---|---|---|---|---|
| 5,209,465 | A * | 5/1993 | Sayama et al. | 271/110 |
| 5,474,288 | A * | 12/1995 | Lo et al. | 271/110 |
| 5,551,684 | A * | 9/1996 | Sata | 271/110 |
| 7,185,885 | B2 * | 3/2007 | Chelvayohan | 271/110 |
| 7,703,763 | B2 * | 4/2010 | Shiohara et al. | 271/145 |
| 2002/0084574 | A1 * | 7/2002 | Kim | 271/118 |
| 2003/0085506 | A1 * | 5/2003 | Kubo | 271/117 |
| 2007/0001374 | A1 * | 1/2007 | Lee | 271/117 |
| 2008/0265490 | A1 * | 10/2008 | Hendrix et al. | 271/117 |

FOREIGN PATENT DOCUMENTS

| | | |
|---|---|---|
| JP | 55-031119 U | 8/1978 |
| JP | 5-32347 | 4/1993 |
| JP | 08-101460 A | 4/1996 |

* cited by examiner

*Primary Examiner* — Prasad Gokhale
(74) *Attorney, Agent, or Firm* — Maschoff Brennan

(57) ABSTRACT

A transport device includes a set section, a sheet sensor, and a feeding member. When a detection member does not retract, the sheet sensor outputs an OFF-detection signal. The feeding member is displaced between a feed position and a non-feed position on the basis of the detection signal. At the feed position, the feeding member comes in contact with the sheet set in the set section from above and feeds the sheet toward the downstream side on a transport path. At the non-feed position, the feeding member is separated upward from the feed position. A method, which detects a sheet in the transport device, includes displacing the feeding member from the non-feed position to the feed position, and detecting that the sheet does not exist in the set section when an OFF-detection signal is output from the sheet sensor while the feeding member is positioned at the feed position.

6 Claims, 7 Drawing Sheets

METHOD OF DETECTING SHEET IN TRANSPORT DEVICE, TRANSPORT DEVICE, IMAGE READING DEVICE, AND IMAGE FORMING APPARATUS

BACKGROUND

1. Technical Field

The present invention relates to a method of detecting a sheet in a transport device that transports, for example, a sheet, an image reading device that reads an image recorded on a sheet transported by a transport device, and an image forming apparatus that records an image read by the image reading device.

2. Related Art

In general, there is known a complex machine as an image forming apparatus that has a transport function for transporting a sheet used as base paper, a reading function for reading an image of the transported sheet, and a recording function for recording the read image on a recording sheet or the like. In the complex machine, a plurality of sheets is set to be stacked in a set section and the sheets are sequentially transported one by one. Further, the set section is provided with a sheet sensor that can detect whether a sheet exists or not. Accordingly, when all the sheets set in the set section are transported and do not exist, the nonexistence of the sheet is detected by the sheet sensor.

In the past, a sensor (hereinafter, referred to as a "sensor in the related art") disclosed in, for example, JP-UM-A-5-32347, has been widely employed as the sheet sensor. The sensor includes a detection lever of which the end freely extends back and forth to the sheet set face of the set section, and the detection lever is pushed so that the end of the detection lever always protrudes upward from the set face. Further, the sensor in the related art detects whether a sheet exists or not by whether a sheet stacked on the set face of the set section presses the end of the detection lever in a retracting direction.

However, in the above-mentioned sensor in the related art, if there is warping or a wrinkle on the sheet set in the set section and the sheet is thus deformed, when the position of a portion having warped or the wrinkle corresponds to the detection lever, the end of the detection lever is not pressed by the sheet or a pressing force of the sheet becomes insufficient. For this reason, in that case, there is a problem as follows: there is a false detection that the sheet set in the set section does not exist even though there are sheets remaining in the set section.

SUMMARY

An advantage of some aspects of the invention is to provide a method of detecting a sheet in a transport device that can reliably detect whether a sheet set in a set section exists or not, a transport device, an image reading device, and an image forming apparatus.

According to an aspect of the invention, there is provided a method of detecting a sheet in a transport device. The transport device includes a set section, a sheet sensor, and a feeding member. The set section includes a set face on which a sheet can be set. When a detection member, which is provided on the set face of the set section so as to freely extend back and from the lower side, receives pressure from the sheet set in the set section and retracts, the sheet sensor outputs an ON-detection signal. When the detection member does not retract, the sheet sensor outputs an OFF-detection signal. The feeding member is displaced between a feed position and a non-feed position on the basis of the detection signal output from the sheet sensor. At the feed position, the feeding member comes in contact with the sheet set in the set section from above and feeds the sheet toward the downstream side on a transport path. At the non-feed position, the feeding member is separated upward from the feed position. The method includes displacing the feeding member from the non-feed position to the feed position, and detecting that the sheet does not exist in the set section when an OFF-detection signal is output from the sheet sensor while the feeding member is positioned at the feed position.

In general, if there is warping or a wrinkle on the sheet set in the set section and the sheet is thus deformed, the detection member does not receive pressure from the sheet and the detection member does not retract despite the existence of the sheet in the set section. In this case, since an OFF-detection signal is output from the sheet sensor, there is a false detection that the sheet does not exist in the set section. In this regard, according to this structure, if an OFF-detection signal is output from the sheet sensor when the feeding member is displaced to the feed position where the feeding member comes in contact with the sheet from above and the feeding member is positioned at the feed position, it is detected that a sheet does not exist in the set section. That is, when the feeding member is positioned at the feed position, the sheet set in the set section is pressed by the feeding member. Accordingly, even though the sheet is deformed, the detection member reliably receives pressure from the sheet. If an OFF-detection signal is output from the sheet sensor in this state, it is detected that a sheet does not exist in the set section. Accordingly, it may be possible to reliably avoid that an OFF-detection signal is output from the sheet sensor despite the existence of the sheet in the set section. As a result, it may be possible to reliably detect whether the sheet set in the set section exists or not.

According to another aspect of the invention, there is provided a transport device that includes a set section, a sheet sensor, a feeding member, and a controller. The set section includes a set face on which a sheet can be set. When a detection member receives pressure from the sheet set in the set section and retracts, the sheet sensor outputs an ON-detection signal. When the detection member does not retract, the sheet sensor outputs an OFF-detection signal. The detection member is provided on the set face of the set section so as to freely extend back and forth from the lower side. The feeding member is displaced between a feed position and a non-feed position. At the feed position, the feeding member comes in contact with the sheet set in the set section from above and feeds the sheet toward the downstream side on a transport path. At the non-feed position, the feeding member is separated upward from the feed position. The controller controls a displacing operation of the feeding member on the basis of the detection signal output from the sheet sensor. The controller displaces the feeding member from the non-feed position to the feed position, and displaces the feeding member from the feed position to the non-feed position when an OFF-detection signal is output from the sheet sensor while the feeding member is positioned at the feed position.

In general, if there is warping or a wrinkle on the sheet set in the set section and the sheet is thus deformed, the detection member does not receive pressure from the sheet and the detection member does not retract despite the existence of the sheet in the set section. In this case, since an OFF-detection signal is output from the sheet sensor, there is a false detection that the sheet does not exist in the set section. In this regard, according to this structure, if an OFF-detection signal is output from the sheet sensor when the controller displaces the feeding member from the non-feed position to the feed position and the feeding member is positioned at the feed position, the controller displaces the feeding member from the feed position to the non-feed position. That is, when the feeding member is positioned at the feed position, the sheet set in the set section is pressed by the feeding member. Accordingly, even though the sheet is deformed, the detection member reliably receives pressure from the sheet. If an OFF-detection signal is output from the sheet sensor in this state, the controller displaces the feeding member from the feed position to the non-feed position. Accordingly, it may be possible to reliably avoid that an OFF-detection signal is output from the sheet sensor despite the existence of the sheet in the set section. As a result, it may be possible to reliably detect whether the sheet set in the set section exists or not.

In the transport device according to the aspect of the invention, the detection member of the sheet sensor may be disposed near a position where the feeding member comes in contact with the set face when the feeding member is displaced to the feed position.

According to this structure, even though the sheet set in the set section is deformed, the feeding member presses the sheet when the feeding member is displaced to the feed position. Accordingly, since the detection member further reliably receives pressure from the sheet, it may be possible to further reliably detect by using the sheet sensor whether the sheet set in the set section exists or not.

According to another aspect of the invention, there is provided an image reading device that includes the transport device that has the above-mentioned structure and a reading unit that reads an image recorded on the sheet transported by the transport device.

According to this structure, it may be possible to obtain the same advantages as the transport device.

According to another aspect of the invention, there is provided an image forming apparatus that includes the image reading device that has the above-mentioned structure and a recording unit that records an image read by the image reading device.

According to this structure, it may be possible to obtain the same advantages as the transport device.

BRIEF DESCRIPTION OF THE DRAWINGS

The invention will be described with reference to the accompanying drawings, wherein like numbers reference like elements.

DESCRIPTION OF EXEMPLARY EMBODIMENTS

An image forming apparatus according to an embodiment of the invention, which is applied to a complex machine, will be described below with reference to drawings. Meanwhile, in the following description, a "longitudinal direction", a "width direction", and a "vertical direction" respectively represent the longitudinal direction, the width direction, and the vertical direction, which are indicated by arrows in FIG. 1.

Figure 1:
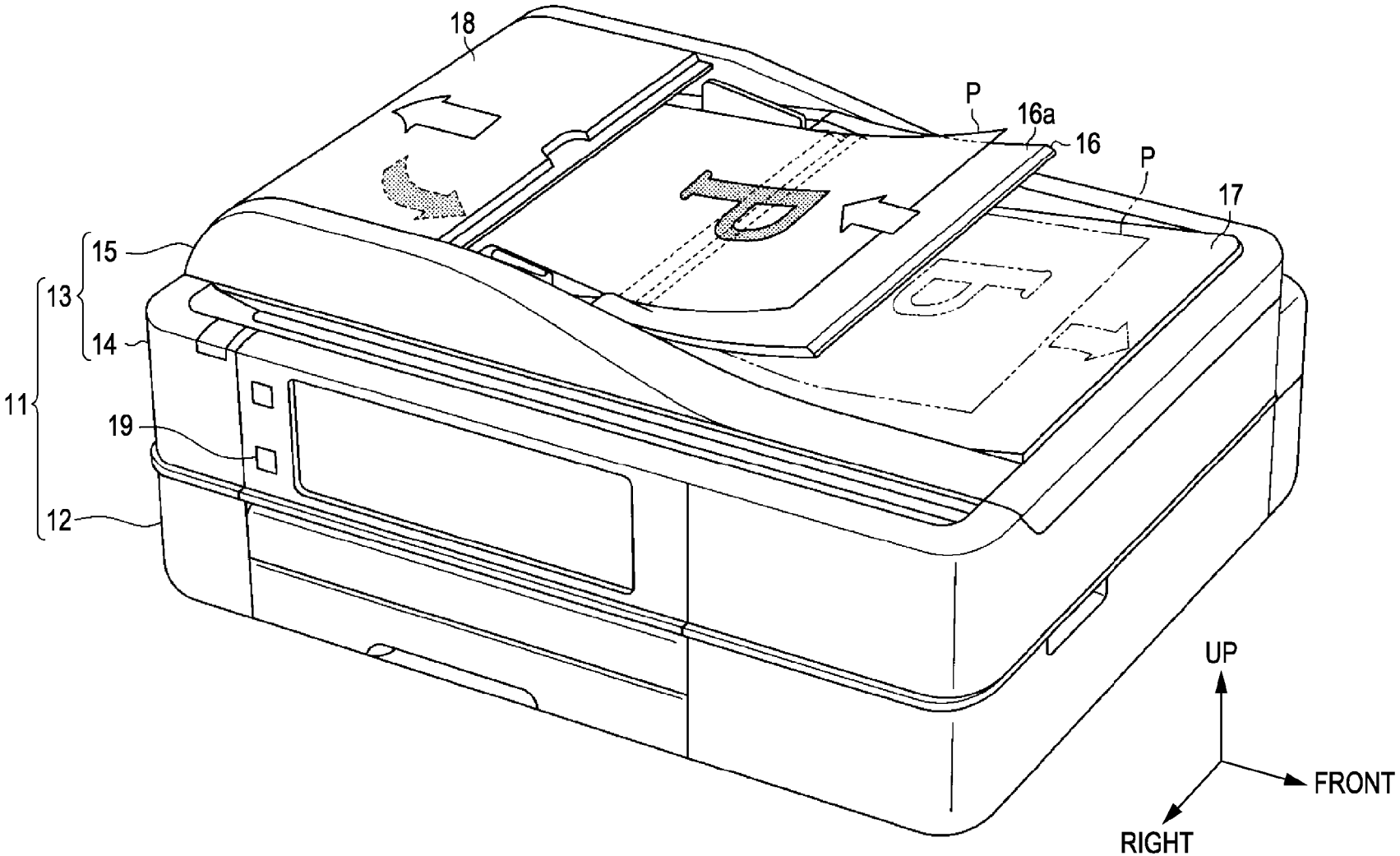
FIG. 1 is a perspective view of a complex machine according to an embodiment of the invention.

As shown in FIG. 1, a complex machine 11 used as an image forming apparatus includes a printer unit 12 that functions as a recording unit, and a scanner device 13 that functions as an image reading device and is disposed on the printer unit 12. The complex machine has a substantially rectangular parallelepiped shape. The scanner device 13 includes a scanner unit 14 that functions as a reading unit, and a transport unit 15 that functions as a transport device and is disposed on the scanner unit 14.

The transport unit 15 includes a paper feed tray 16 that functions as a set section in which a plurality of paper sheets P used as sheets can be set in a stacked state, and a paper discharge tray 17 that is positioned below the paper feed tray 16. The paper feed tray 16 is inclined downward toward the rear side, and the upper surface of the paper feed tray functions as a set face **16*a* on which paper sheets P are set. A reverse cover 18, which covers the rear portion of the paper feed tray 16, is provided at the upper rear end of the transport unit 15** so as to be freely opened and closed.

When a user operates a start switch 19 provided on the right surface of the scanner unit 14, the paper sheets P set on the set face **16*a* of the paper feed tray 16 positioned one by one upstream on a transport path of the paper sheet P are transported to the paper discharge tray 17**, which is positioned downstream on the transport path.

In this case, an image (character "P" in this embodiment) is recorded on the upper surface of each of the paper sheets P that are set on the set face **16*a* of the paper feed tray 16. The paper sheet is reversed while being transported, and the image is read by the scanner unit 14. Then, the paper sheet is discharged onto the paper discharge tray 17 so that the surface of the sheet paper on which the image is printed faces the lower side. Further, the image read by the scanner unit 14 is printed on an unused paper sheet (not shown) by the printer unit 12**.

Figure 2:
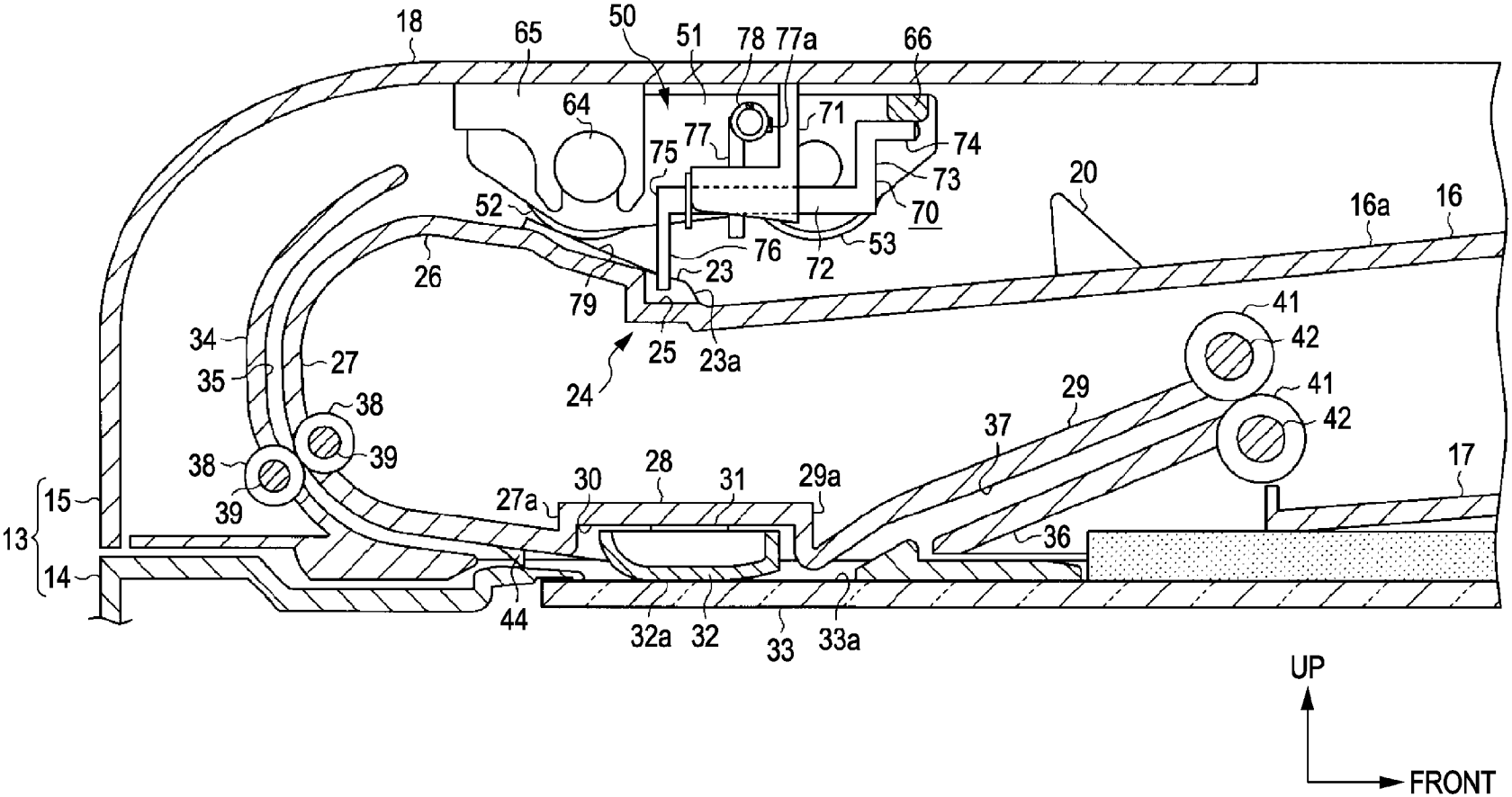
FIG. 2 is a schematic cross-sectional view of main parts of the complex machine.

As shown in FIG. 2, a first detection lever 20, which is used as a detection member having the shape of a right triangle of which the front side (as seen in the width direction) is an oblique side, is provided on the set face **16*a* near the rear portion of the paper feed tray 16 so as to freely extend back and forth from the lower side. The first detection lever 20 is pushed by a spring (not shown), which is provided in the paper feed tray 16, so as to always protrude upward from the set face 16*a*. Accordingly, if a paper sheet P is set on the set face 16*a*, the first detection lever retracts into the paper feed tray 16** against the pushing force of the spring (not shown) due to the weight of the paper sheet P (due to the pressure applied from the paper sheet P).

Further, a first detection part 21 (see FIG. 6), which detects whether the first detection lever 20 retracts into the paper feed tray 16, is provided in the paper feed tray 16. If the first detection lever 20 retracts into the paper feed tray 16, the first detection part 21 (see FIG. 6) outputs an ON-detection signal. If the first detection lever 20 does not retract into the paper feed tray 16, the first detection part outputs an OFF-detection signal.

That is, in general, the first detection part 21 (see FIG. 6) outputs an ON-detection signal when the paper sheet P is set on the set face **16*a*, and outputs an OFF-detection signal when there is no paper sheet P on the set face 16*a*. Meanwhile, in this embodiment, a paper sheet detecting sensor 22 (see FIG. 6) used as a sheet sensor is formed of the first detection lever 20 and the first detection part 21 (see FIG. 6**).

Figure 3:
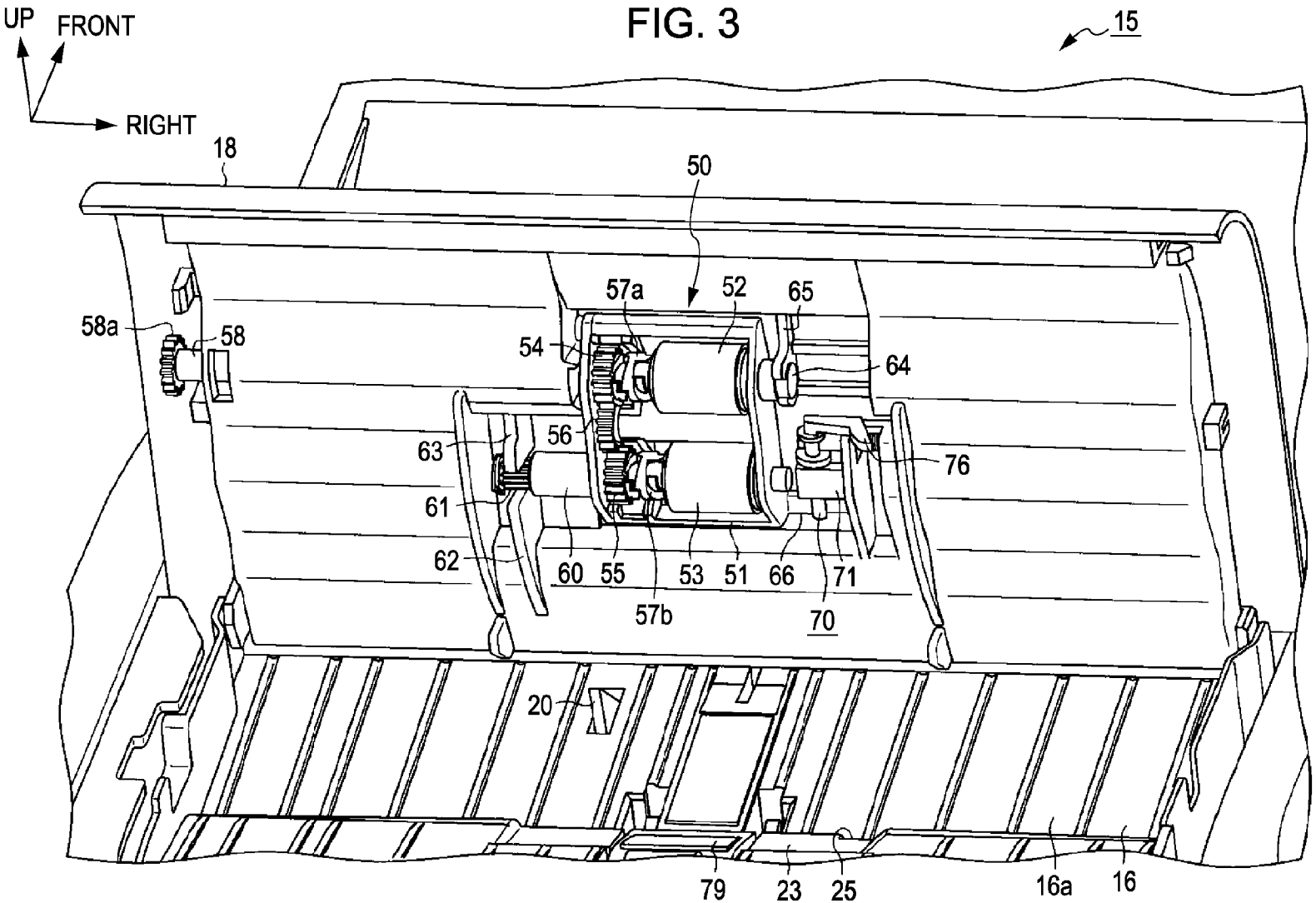
FIG. 3 is an enlarged perspective view of the main parts when a reverse cover of a transport unit is opened.

As shown in FIGS. 2 and 3, a stepped portion 23 including a slope 23*a* is formed at the rear end of the paper feed tray 16. When the paper sheet P is set on the set face 16*a*, the end (rear end) of the paper sheet P comes in contact with the slope so that the paper sheet P is set into position. The stepped portion 23 extends over the entire width of the paper feed tray 16 in the width direction of the paper feed tray, and the slope 23*a* inclined upward toward the rear side. A position, where the front end of the paper sheet P is positioned in the longitudinal direction when the paper sheet P is set on the set face 16*a*, is referred to as a set position 24, and the stepped portion 23 is positioned at the set position 24.

A recess 25, which has opened upper and front sides, is formed at a portion of the stepped portion 23 that is slightly closer to the right side than the middle of the stepped portion in the width direction. A transport path forming member 26, which forms the transport path of the paper sheet P, is integrally connected to the stepped portion 23 on the rear side of the stepped portion 23. The transport path forming member 26 includes a paper feeding guide section 27, an opposite section 28, and a paper discharging guide section 29. The paper feeding guide section is curved in a U shape so as to rise rearward from the stepped portion 23, extends toward the lower end of the transport unit 15, and then extends forward along the upper surface of the scanner unit 14. The opposite section faces an upper surface 33*a* of a glass 33 that is horizontally disposed at the upper end of the scanner unit 14 and horizontally extends forward. The paper discharging guide section extends substantially in a straight line so as to be inclined upward toward the front side from the opposite section 28.

That is, bent portions 27*a* and 29*a*, which are formed by bending upward the lower ends of the paper feeding guide section 27 and the paper discharging guide section 29 in a vertical direction, are respectively formed at the lower ends of the paper feeding guide section 27 and the paper discharging guide section 29. The upper ends of the bent portions 27*a* and 29*a* are connected to each other by the opposite section 28. Accordingly, an opposite recess 30, which includes the opposite section 28 as a bottom and is opened at the lower portion thereof, is formed by the opposite section 28 and the bent portions 27*a* and 29*a*. A paper sheet pressing member 32 is provided in the opposite recess 30, that is, on the lower surface of the opposite section 28 with a spring 31 interposed therebetween so as to extend in the width direction. The paper sheet pressing member 32 has a substantially U shape in cross-sectional view, and the lower end surface 32*a* of the paper sheet pressing member forms a horizontal surface. Further, the lower end surface 32*a* of the paper sheet pressing member 32 is always pressed against the upper surface 33*a* of the glass 33 by the pushing force of the spring 31.

A paper feed guide 34, which extends along the paper feeding guide section 27, is provided on the rear side of the paper feeding guide section 27 of the transport path forming member 26 in the transport unit 15. A gap formed between the paper feed guide 34 and the paper feeding guide section 27 serves as a paper feed passage 35 that forms a part of the transport path of the paper sheet P. A pair of paper feed rollers 38, which pinches the paper sheet P passing through the paper feed passage 35 and feeds the paper sheet toward the downstream side, is provided at a position, which is close to the downstream side on the paper feed passage 35, so as to each rotate about rotating shafts 39 that extend in the width direction. Each of the rotating shafts 39 is rotationally driven by a paper feed motor 40 (see FIG. 6) that is provided in the transport unit 15. Accordingly, if the paper feed motor 40 (see FIG. 6) is driven, each of the paper feed rollers 38 is rotationally driven together with each of the rotating shafts 39.

Meanwhile, a paper discharge guide 36, which extends along the discharging guide section 29, is provided below the paper discharging guide section 29 of the transport path forming member 26 in the transport unit 15. A gap formed between the paper discharge guide 36 and the paper discharging guide section 29 serves as a paper discharge passage 37 that forms a part of the transport path of the paper sheet P. A pair of paper discharge rollers 41, which pinches the paper sheet P passing through the paper discharge passage 37 and feeds the paper sheet toward the paper discharge tray 17, is provided at the downstream end of the paper discharge passage 37 so as to each rotate about rotating shafts 42 that extend in the width direction. Each of the rotating shafts 42 is rotationally driven by a paper discharge motor 43 (see FIG. 6) that is provided in the transport unit 15. Accordingly, if the paper discharge motor 43 (see FIG. 6) is driven, each of the paper discharge rollers 41 is rotationally driven together with each of the rotating shafts 42.

Further, a second detection lever 44, which has the shape of a right triangle of which the rear side (herein, a side corresponding to the upstream side of the paper sheet P) (as seen in the width direction) is an oblique side, is provided on the transport path of the paper sheet P at the lower end of the paper feeding guide section 27 of the transport path forming member 26 so as to freely extend back and forth from the upper side. The second detection lever 44 is pushed by a spring (not shown), which is provided in the paper feeding guide section 27, so as to always protrude upward from the transport path of the paper sheet P. Accordingly, if being pressed forward (toward the downstream side of the paper sheet P) by the front end of the paper sheet P transported on the transport path, the second detection lever retracts into the paper feeding guide section 27 against the pushing force of the spring (not shown).

Further, a second detection part 45 (see FIG. 6) which detects whether the second detection lever 44 retracts into the paper feeding guide section 27, is provided in the paper feeding guide section 27. If the second detection lever 44 retracts into the paper feeding guide section 27, the second detection part 45 (see FIG. 6) outputs an ON-detection signal. If the second detection lever 44 does not retract into the paper feeding guide section 27, the second detection part outputs an OFF-detection signal. Meanwhile, in this embodiment, a paper sheet-end sensor 46 (see FIG. 6) is formed of the second detection lever 44 and the second detection part 45 (see FIG. 6).

As shown in FIGS. 2 and 3, a separation pad 79 is provided in the middle of the stepped portion 23 in the width direction, and the separation pad 79 is pushed upward by a spring (not shown). Further, a feed roller unit 50 functioning as a feeding member, which can feed the paper sheet P set on the set face 16*a* toward the downstream side, is swingably supported on the inner surface of the reverse cover 18 at a position facing the stepped portion 23.

Figure 4:
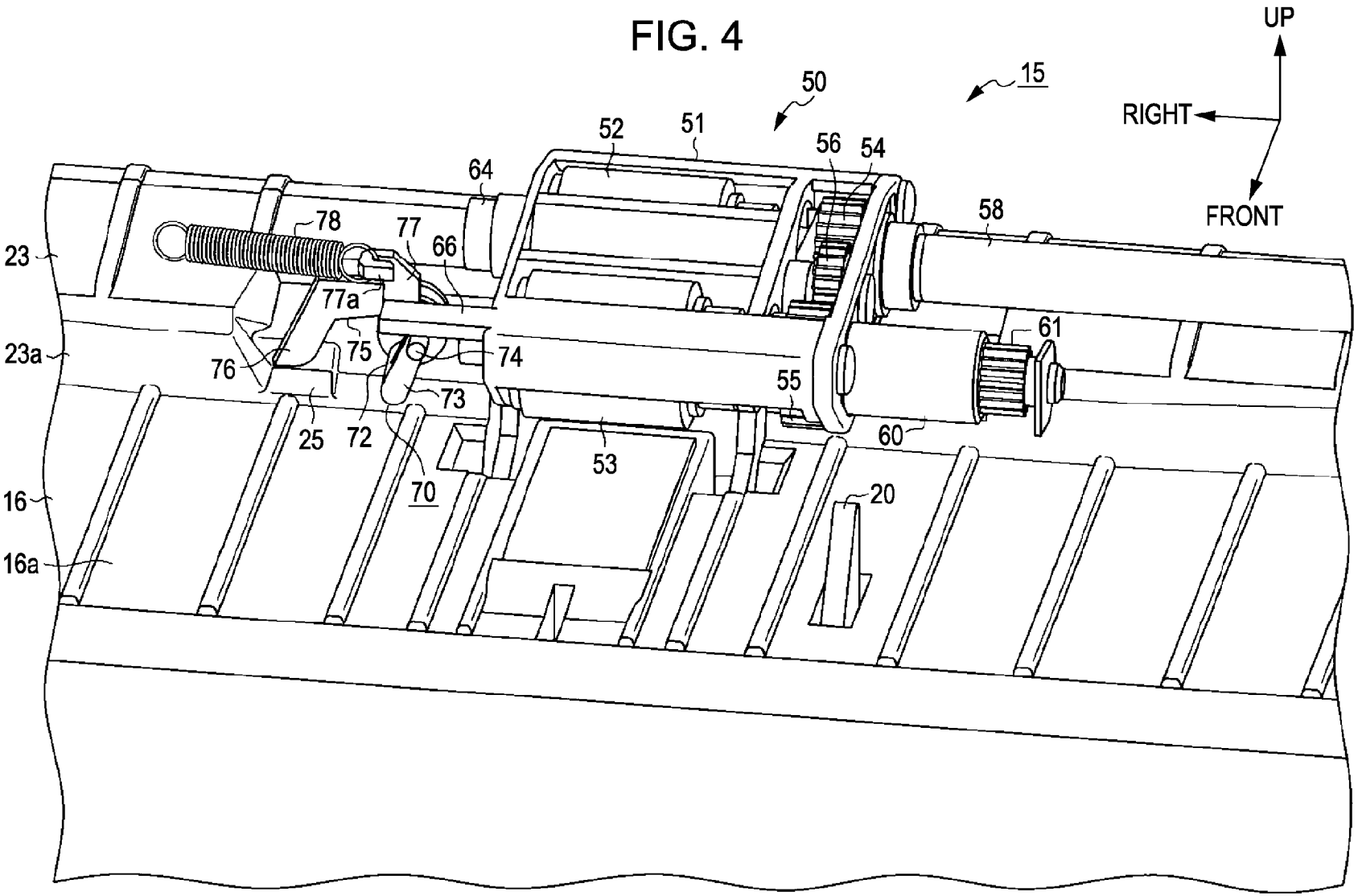
FIG. 4 is an enlarged perspective view of the main parts of the transport unit when the reverse cover is omitted and a feed roller unit is positioned at a non-feed position.

As shown in FIGS. 3 and 4, the feed roller unit 50 includes a frame 51 that has a substantially rectangular shape in plan view. First and second feed rollers 52 and 53 are rotatably supported in the frame 51 so as to make a pair, and are positioned parallel to each other in the longitudinal direction. That is, the first feed roller 52 is disposed on the rear side of the second feed roller 53 in the frame 51, and the first and second feed rollers are each rotatable about axes extending in the width direction. In this case, the first feed roller 52 is positioned so as to always come in contact with the upper surface of the separation pad 79.

In the frame 51, first and second gears 54 and 55 are rotatably supported on the left side of the first and second feed rollers 52 and 53. The first gear 54 and the first feed roller 52 are rotatable about the same axis, and the second gear 55 and the second feed roller 53 are rotatable about the same axis. Further, a transmission gear 56 is rotatably supported between the first and second gears 54 and 55 in the frame 51, and the transmission gear 56 meshes with the first and second gears 54 and 55.

A first one-way clutch 57*a* is provided between the first feed roller 52 and the first gear 54. When the first gear 54 is rotated in a normal direction (rotated clockwise in this embodiment as seen from the right side), the first one-way clutch 57*a* transmits the torque of the first gear 54 to the first feed roller 52. When the first gear 54 is rotated in a reverse direction (rotated counterclockwise in this embodiment as seen from the right side), the first one-way clutch does not transmit the torque of the first gear 54 to the first feed roller 52.

Likewise, a second one-way clutch 57*b*, which has exactly the same structure as the first one-way clutch 57*a*, is provided between the second feed roller 53 and the second gear 55. Accordingly, when the second gear 55 is rotated in the normal direction, the torque of the second gear 55 is transmitted to the second feed roller 53 by the second one-way clutch 57*b*. When the second gear 55 is rotated in the reverse direction, the torque of the second gear 55 is not transmitted to the second feed roller 53 by the second one-way clutch.

A main shaft 58, which extends in the width direction and is rotated about the axis of the first feed roller 52, is rotatably supported on the inner surface of the reverse cover 18. A right end of the main shaft 58 passes through the left wall of the frame 51 and is connected to the first gear 54. A main shaft gear 58*a* is fixed to the left end of the main shaft. The main shaft 58 and the first gear 54 are rotated about the same axis as a single body. The main shaft supports the left wall of the frame 51 while not interfering with the rotation thereof.

Further, the main shaft gear 58*a* of the main shaft 58 meshes with a motor gear (not shown) fixed to an output shaft (not shown) of the feeding motor 59 (see FIG. 6), which is provided in the transport unit 15, through a motor transmission gear (not shown). Accordingly, the feeding motor 59 is driven in the normal direction when the main shaft 58 is rotated in the normal direction, and is rotated in the reverse direction when the feeding motor 59 is driven in the reverse direction.

A sub-shaft 60 is connected to the second gear 55 from the left side, and the sub-shaft 60 and the second gear 55 are rotated about the same axis as a single body. The sub-shaft 60 passes through the left wall of the frame 51 and protrudes from the left side of the frame 51 toward the outside of the frame 51. A sub-shaft gear 61 is fixed to the end (left end) of the sub-shaft 60, and the left wall of the frame 51 does not interfere with the rotation of the sub-shaft gear. Further, the sub-shaft gear 61 is interposed in the longitudinal direction between front and rear support plates 62 and 63, which are provided on the inner surface of the reverse cover 18.

The surface of the front support plate 62, which faces the sub-shaft gear 61, comes in contact with and slides across the sub-shaft gear 61. Meanwhile, a rack (not shown), which extends in the vertical direction, is formed on the surface of the rear support plate 63 that faces the sub-shaft gear 61. The rack meshes with the sub-shaft gear 61. Accordingly, when the sub-shaft gear 61 (sub-shaft 60) is rotated in the normal direction, the sub-shaft gear 61 is moved down along the rack (not shown) of the rear support plate 63 while being rotated. When the sub-shaft gear 61 (sub-shaft 60) is rotated in the reverse direction, the sub-shaft gear 61 is moved up along the rack (not shown) of the rear support plate 63 while being rotated.

A covered cylindrical support 64 protrudes toward the right side from the outer surface of the right wall of the frame 51 at a position corresponding to the first feed roller 52. A step is formed at the support 64 so that the outer diameter of the end portion of the support is smaller than that of the base portion thereof. Accordingly, the end portion of the support is rotatably supported by the support member 65 that is provided on the inner surface of the reverse cover 18. In addition, an engagement arm 66, which extends toward the right side, is formed at the upper front end on the outer surface of the right wall of the frame 51.

Further, when the first and second feed rollers 52 and 53 are parallel to each other in a horizontal direction (see FIGS. 2 and 4), the position of the feed roller unit 50 is referred to as a non-feed position. When being positioned at the non-feed position, the feed roller unit does not feed the paper sheet P set on the set face 16*a* toward the downstream side of the transport path. That is, when the feed roller unit 50 is positioned at the non-feed position, the second feed roller 53 is separated upward from the set face 16*a* or the paper sheet P that is set on the set face 16*a*. Meanwhile, when the transport unit 15 is in a standby state, the feed roller unit 50 is generally positioned at the non-feed position.

Figure 5:
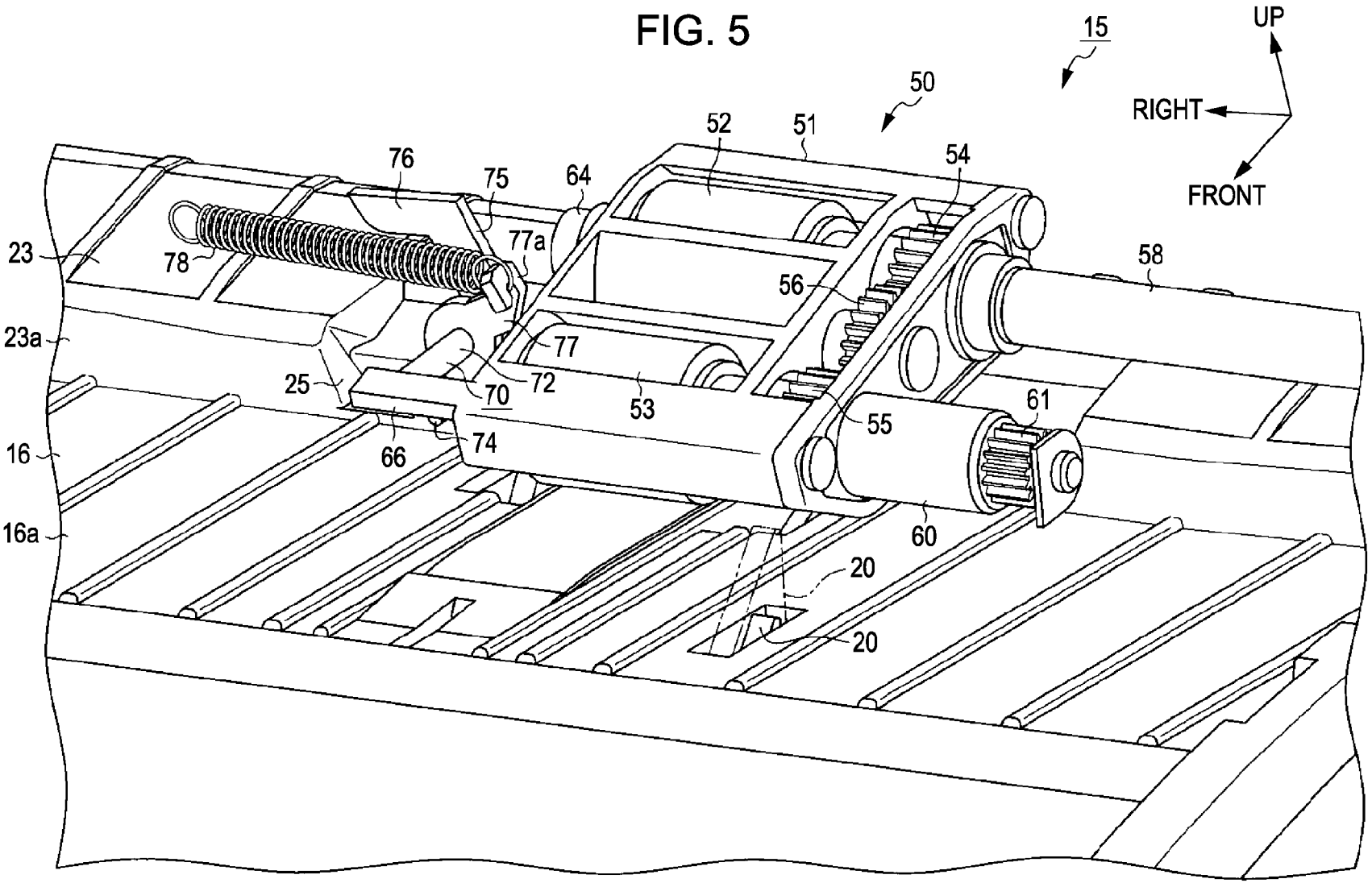
FIG. 5 is an enlarged perspective view of the main parts of the transport unit when the reverse cover is omitted and the feed roller unit is positioned at a feed position.

Further, if the main shaft 58 is rotated in the normal direction when the feed roller unit 50 is positioned at the non-feed position, the first gear 54 is rotated in the normal direction. Accordingly, the transmission gear 56 is rotated in the reverse direction and the second gear 55 is rotated in the normal direction. In this case, the torque of the first and second gears 54 and 55 is respectively transmitted to the first and second feed rollers 52 and 53 by the first and second one-way clutches 57*a* and 57*b* so that the first and second feed rollers 52 and 53 are rotated in the normal direction, In this case, if the sub-shaft 60 is rotated in the normal direction as the second gear 55 is rotated in the normal direction, the sub-shaft gear 61 meshes with the rack (not shown) of the rear support plate 63 and is moved down along the rack while being rotated. Accordingly, the feed roller unit 50 is swung about the main shaft 58 so that the front portion of the feed roller unit is lower then the rear portion thereof. The feed roller unit is inclined so that the front portion of the feed roller unit is lower than the rear portion thereof, that is, the feed roller unit is in a state where the second feed roller 53 comes in contact with the set face 16*a* or the paper sheet P that is set on the set face 16*a* (see FIG. 5).

Accordingly, in this state, the feed roller unit 50 can feed the paper sheet P, which is set on the set face 16*a*, toward the downstream side of the transport path. In this case, the position of the feed roller unit 50 is referred to as a feed position. Meanwhile, the first detection lever 20 is disposed near a position where the second feed roller 53 of the feed roller unit 50 can come in contact with the set face 16*a* when the feed roller unit 50 is positioned at the feed position.

Meanwhile, if the main shaft 58 is rotated in the reverse direction when the feed roller unit 50 is positioned at the feed position, the first gear 54 is rotated in the reverse direction. Accordingly, the transmission gear 56 is rotated in the normal direction and the second gear 55 is rotated in the reverse direction. In this case, the torque of the first and second gears 54 and 55 is not respectively transmitted to the first and second feed rollers 52 and 53 by the first and second one-way clutches 57*a* and 57*b*. Further, in this case, if the sub-shaft 60 is rotated in the reverse direction as the second gear 55 is rotated in the reverse direction, the sub-shaft gear 61 meshes with the rack (not shown) of the rear support plate 63 and is moved up along the rack while being rotated. Accordingly, the feed roller unit 50 is displaced to the feed position.

Therefore, the feed roller unit 50 is displaced between the feed position and the non-feed position. That is, the feed roller unit 50 may be swung about the main shaft 58 between the feed position and the non-feed position.

As shown in FIGS. 2 to 4, a restricting member 70 made of a hard synthetic resin is disposed on the right side of the feed roller unit 50. The restricting member 70 is supported by a support arm 71 that is provided on the inner surface of the reverse cover 18. That is, the restricting member 70 includes a shaft 72 extending in the longitudinal direction that is the transport direction of the paper sheet P at the set position 24 and the shaft 72 is rotatably supported by the support arm 71.

A front connection portion 73, which extends straight upward so as to be slightly inclined toward the left side from the vertical direction, is integrally formed with the front end of the shaft 72. A columnar engagement portion 74, which extends in a straight line toward the front side, is integrally formed with the upper end of the front connection portion 73. Further, the engagement portion 74 comes in contact with the lower surface of the engagement arm 66 of the feed roller unit 50 that is positioned at the non-feed position.

Meanwhile, a rear connection portion 75, which extends straight toward the right side, is integrally formed with the rear end of the shaft 72. A plate-like restricting section 76, which extends straight toward the lower side, is integrally formed with the right end of the rear connection portion 75. The end (lower end) of the restricting section 76 is inserted into the recess 25. That is, when the feed roller unit 50 is positioned at the non-feed position, the end of the restricting section 76 is inserted into the recess 25 (see FIGS. 2 and 4). In this state, the restricting section 76 crosses the transport path of the paper sheet P in the vertical direction that is the thickness direction of the paper sheet P. For this reason, the restricting section 76 protrudes on the transport path of the paper sheet P, and blocks the transport path in the vertical direction without leaving a gap. Further, the position of the restricting member 70 in this case is referred to as a first position.

Furthermore, a locking portion 77, which extends straight upward in the vertical direction, is integrally formed with the shaft 72 at a position that is slightly closer to the rear side than the middle of the shaft 72 in the longitudinal direction. A hook 77*a*, which has a U shape in plan view, is formed at the upper end of the locking portion 77. One end of a coil spring 78, which functions as a pusher extending in the width direction, is caught by the hook 77*a*. The other end of the coil spring 78 is caught by a hook piece (not shown) that is formed on the inner surface of the reverse cover 18.

Further, if the feed roller unit 50 is displaced from the non-feed position to the feed position, the engagement portion 74 of the restricting member 70 is pressed down by the engagement arm 66 of the feed roller unit 50. In this case, the shaft 72 is rotated clockwise (as seen from the front side) against the pushing force of the coil spring 78 by the front connection portion 73, and the restricting section 76 is rotated clockwise (as seen from the front side) about the shaft 72 by the rear connection portion 75 with the rotation of the shaft 72. Accordingly, the restricting member 70 is in a state where the restricting section 76 is separated from the recess 25 and moved up (see FIG. 5), that is, the restricting section 76 retracts upward from the transport path of the paper sheet P. Further, the position of the restricting member 70 in this case is referred to as a second position.

Meanwhile, if the feed roller unit 50 is displaced from the feed position to the non-feed position, the shaft 72 of the restricting member 70 is rotated counterclockwise (as seen from the front side) by the pushing force of the coil spring 78. Accordingly, the shaft 72 is rotated counterclockwise (as seen from the front side) with the rotation of the shaft 72 so that the engagement portion 74 follows the engagement arm 66 of the feed roller unit 50. As a result, the restricting member 70 is again in a state where the restricting section 76 is inserted into the recess 25, that is, the restricting section 76 protrudes from the transport path of the paper sheet P from above.

The electrical configuration of the complex machine 11 will be described below.

Figure 6:
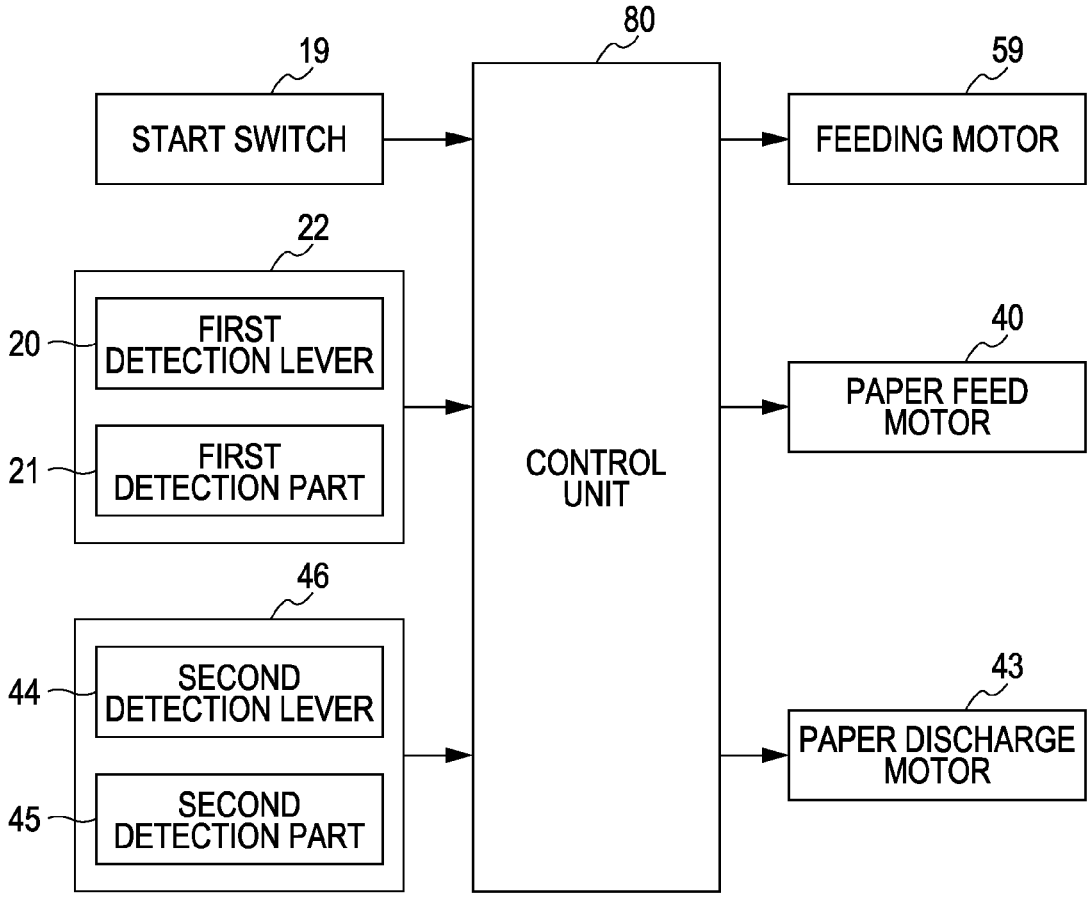
FIG. 6 is a block diagram showing the electrical configuration of the complex machine.

As shown in FIG. 6, the complex machine 11 includes a control unit 80, which functions as a controller for controlling the operation of the complex machine 11. The start switch 19, the paper sheet detecting sensor 22, the paper sheet-end sensor 46, the feeding motor 59, the paper feed motor 40, and the paper discharge motor 43 are electrically connected to the control unit 80. Further, an operation signal output when a user operates the start switch 19, an ON-detection signal or an OFF-detection signal that is output from the paper sheet detecting sensor 22, and an ON-detection signal or an OFF-detection signal that is output from the paper sheet-end sensor 46 are input to the control unit, so that the control unit 80 controls the driving of the feeding motor 59, the paper feed motor 40, and the paper discharge motor 43. Meanwhile, the control unit 80 includes a memory (not shown), and a program for transporting a paper sheet is stored in the memory.

The operation of the transport unit 15, when a user sets the paper sheet P on the set face 16*a* of the paper feed tray 16, will be described below.

The setting of the paper sheet P on the set face 16*a* is performed when the transport unit 15 is in a standby state. Accordingly, in this standby state, the feed roller unit 50 is positioned at the non-feed position, that is, the restricting member 70 is positioned at the first position. Further, in this state, a user inserts (pushes) by hand the stacked paper sheets P into the gap between the set face 16*a* and the feed roller unit 50 (toward the rear side) along the set face 16*a*. Accordingly, the front end of each paper sheet P comes in contact with the slope 23*a*, so that each paper sheet P is set into position.

Further, if each paper sheet P is vigorously inserted toward the rear side on the set face 16*a* by a user, the front ends of some paper sheets P among the paper sheets P get over the slope 23*a*. However, since the front ends of the paper sheets P getting over the slope 23*a* come in contact with the restricting section 76 of the restricting member 70, the paper sheets P do not get over the set position 24 toward the downstream side of the transport path. Accordingly, the front end of each paper sheet P is stopped at the set position 24.

Furthermore, if a user inserts each paper sheet P toward the rear side on the set face 16*a* by a very strong force, a strong pressing force is applied rearward to the restricting section 76 of the restricting member 70 from each paper sheet P inserted by the user. However, the restricting member 70 is rotatable about the shaft 72 extending in a direction where the transport path of the paper sheet P extends (herein, the longitudinal direction). Accordingly, the pressing force is not applied to the restricting member 70, which is positioned at the first position, in a rotational direction. That is, the pressing force is applied to the restricting member 70, which is positioned at the first position, in a direction substantially orthogonal to the rotational direction.

For this reason, the restricting force for restricting the front end of each paper sheet P, which gets over the set position 24 against the pressing force toward the downstream side on the transport path, depends not on the pushing force of the coil spring 78 but the strength of the material of the restricting member 70. Further, since the restricting member 70 is made of a hard synthetic resin in this embodiment, the strength of the restricting member is significantly higher than that of the paper sheet P. For this reason, a restricting force for restricting the front end of each paper sheet P, which gets over the set position 24 against the pressing force toward the downstream side on the transport path, is significantly secured.

Accordingly, when the paper sheet P is set in the paper feed tray 16, the front end of the paper sheet P, which gets over the set position 24 in the paper feed tray 16 toward the downstream side, is reliably restricted by the rotary restricting member 70.

Figure 7:
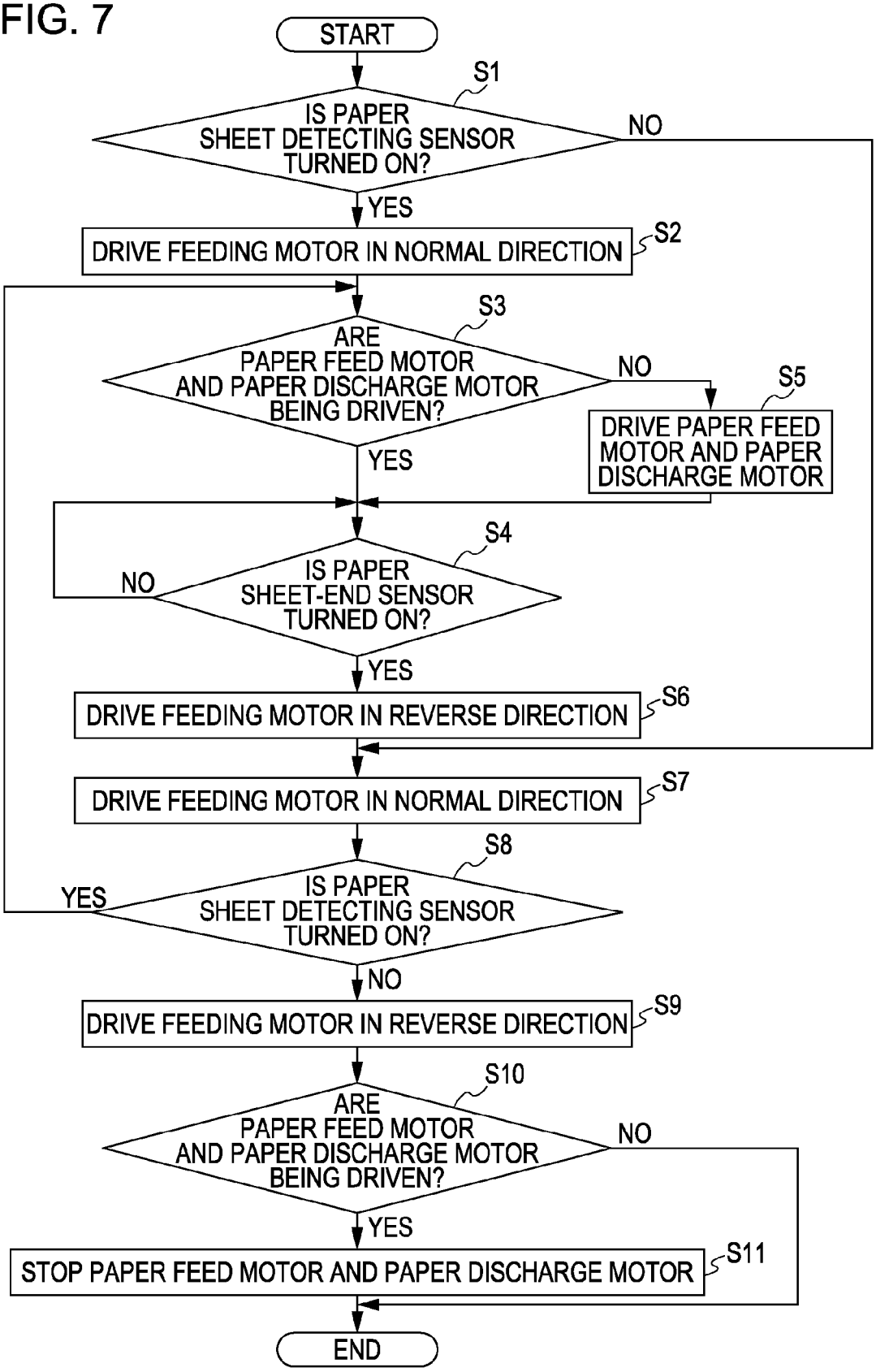
FIG. 7 is a flowchart illustrating a routine for transporting a paper sheet.

A routine for transporting the paper sheet, which is performed by a control unit 80 when a user operates the start switch 19, will be described below with reference to a flowchart of FIG. 7.

Meanwhile, if an operation signal is input to the control unit from the start switch 19, the control unit 80 determines whether an ON-detection signal is input from the paper sheet detecting sensor 22 (Step S1). If the determination result of Step S1 corresponds to a positive determination, the control unit 80 drives the feeding motor 59 in the normal direction on the basis of the ON-detection signal input from the paper sheet detecting sensor 22 and displaces the feed roller unit 50 from the non-feed position to the feed position (Step S2). Then, the restricting member 70 is displaced to the second position from the first position, the second feed roller 53 comes in contact with the uppermost paper sheet P that is set on the set face 16*a* in a stacked state while being rotated in the normal direction, and the paper sheet P is fed toward the paper feed passage 35. That is, a feeding force is applied to the paper sheet P from the first and second feed rollers 52 and 53.

In this case, if a lower paper sheet P is led and moved by the uppermost paper sheet P, the uppermost paper sheet P and the lower paper sheet P are separated from each other when passing between the first feed roller 52 and the separation pad 79, so that only the uppermost paper sheet P is fed toward the paper feed passage 35. Meanwhile, if the determination result of Step S1 corresponds to a negative determination, the control unit 80 makes the process proceed to Step S7 to be described below on the basis of the OFF-detection signal input from the paper sheet detecting sensor 22.

Subsequently, the control unit 80 determines whether the paper feed motor 40 and the paper discharge motor 43 are driven (Step S3). If the determination result of Step S3 corresponds to a positive determination, the control unit 80 determines whether an ON-detection signal is input from the paper sheet-end sensor 46 (Step S4). Meanwhile, if the determination result of Step S3 corresponds to a negative determination, the control unit 80 drives the paper feed motor 40 and the paper discharge motor 43 (Step S5) and makes the process proceed to Step S4. Accordingly, the paper feed roller 38 and the paper discharge roller 41 are rotationally driven.

If the determination result of Step S4 corresponds to a negative determination, the control unit 80 repeatedly performs the process of Step S4 until the determination result of Step S4 becomes a positive determination. Meanwhile, if the determination result of Step S4 corresponds to a positive determination, the control unit 80 drives the feeding motor 59 in the reverse direction and displaces the feed roller unit 50 from the feed position to the non-feed position (Step S6). In this case, a feeding force, which is applied to the paper sheet P from the first and second feed rollers 52 and 53, is lost, but the transport of the paper sheet P has already left to the paper feed roller 38. Accordingly, the paper sheet P is transported without delay onto the upper surface 33*a* of the glass 33 by the paper feed roller 38. Further, when the paper sheet P passes between the upper surface 33*a* of the glass 33 and the paper sheet pressing member 32, the image is read by the scanner unit 14. After that, the paper sheet P passes through the paper discharge passage 37 and is discharged onto the paper discharge tray 17 by the paper discharge roller 41.

Subsequently, after driving the feeding motor 59 in the normal direction and displacing the feed roller unit 50 from the non-feed position to the feed position (Step S7), the control unit 80 determines whether an ON-detection signal is input from the paper sheet detecting sensor 22 (Step S8). Accordingly, Step S8 is performed while the feed roller unit 50 is positioned at the feed position.

In this case, if there are deformations, such as a wrinkle or warping, on the following paper sheet P on the set face 16*a* when Step S8 is performed while the feed roller unit 50 is positioned at the non-feed position, pressure is not sufficiently applied to the first detection lever 20 from the following paper sheet P. For this reason, even though the following paper sheet P exists on the set face 16*a*, an OFF-detection signal, not an ON-detection signal, is input to the control unit 80 from the paper sheet detecting sensor 22.

In this regard, in Step S8 of this embodiment the control unit determines whether an ON-detection signal is input from the paper sheet detecting sensor 22 when the feed roller unit 50 is positioned at the feed position. For this reason, if the following paper sheet P exists on the set face 16*a*, a portion of the paper sheet P corresponding to the first detection lever 20 is pressed from above by the second feed roller 53. Accordingly, even though there are deformations, such as a wrinkle or warping, on the paper sheet P on the set face 16*a*, pressure is sufficiently applied to the first detection lever 20 from the paper sheet P. For this reason, it may be possible to reliably avoid that an OFF-detection signal, not an ON-detection signal, is input to the control unit 80 from the paper sheet detecting sensor 22 despite the existence of the following paper sheet P on the set face 16*a*.

If the determination result of Step S8 corresponds to a positive determination, the control unit 80 makes the process proceed to Step S3 on the basis of the ON-detection signal input from the paper sheet detecting sensor 22. Meanwhile, if the determination result of Step S8 corresponds to a negative determination, the control unit 80 drives the feeding motor 59 in the reverse direction on the basis of the OFF-detection signal input from the paper sheet detecting sensor 22 and displaces the feed roller unit 50 from the feed position to the non-feed position (Step S9).

Subsequently, the control unit 80 determines whether the paper feed motor 40 and the paper discharge motor 43 are being driven (Step S10). If the determination result of Step S10 corresponds to a positive determination, the control unit 80 stops the paper feed motor 40 and the paper discharge motor 43 (Step S11) and then terminates the routine for transporting the paper sheet. Meanwhile, if the determination result of Step S10 corresponds to a negative determination, the control unit 80 terminates the routine for transporting the paper sheet.

According to the above-mentioned embodiment, it may be possible to obtain the following advantages.

(1) The restricting member 70 is rotatable about the shaft 72 extending along the transport path. Accordingly, even if the paper sheet P is strongly pushed toward the downstream side of the set position 24 in the transport direction by a user's manual operation, a pushing force in the rotational direction is not applied to the restricting member 70, which is positioned at the first position. For this reason, the restricting force for restricting the front end of the paper sheet P, which gets over the set position 24 against the pushing force toward the downstream side on the transport path, depends on the strength of the material (a hard synthetic resin in this embodiment) of the restricting member 70. Therefore, when the paper sheet P is set in the paper feed tray 16, it may be possible to reliably restrict the front end of the paper sheet P, which gets over the set position 24 in the paper feed tray 16 toward the downstream side, by the rotary restricting member 70.

(2) When the restricting member 70 is positioned at the first position, the restricting section 76 blocks the transport path of the paper sheet P in the thickness direction of the paper sheet P, which is set in the paper feed tray 16, without leaving a gap. Accordingly, it may be possible to further reliably restrict the front end of the paper sheet P, which gets over the set position 24 in the paper feed tray 16 toward the downstream side.

(3) The recess 25, into which the end of the restricting section 76 is inserted when the restricting member 70 is positioned at the first position, is formed at the set position 24 in the paper feed tray 16. For this reason, even though the restricting section 76 may be pushed to deform by the pushing force that is applied from the front side by the paper sheet P when the restricting member 70 is positioned at the first position, the end of the restricting section 76 is engaged with the rear surface of the recess 25. Accordingly, it may be possible to suppress the deformation of the restricting section 76, that is, to reinforce the restricting section 76.

(4) When the feed roller unit 50 is displaced to the feed position in order to feed the paper sheet P, the engagement portion 74 of the restricting member 70 is pressed by the engagement arm 66 of the feed roller unit 50, so that the restricting member 70 is positioned at the second position. Accordingly, the restricting section 76 reliably retracts from the transport path of the paper sheet P. For this reason, it may be possible to smoothly feed the paper sheet P, which is set in the paper feed tray 16, toward the downstream side of the set position 24 on the transport path by the feed roller unit 50. In this case, since an operation for displacing the restricting member 70 from the first position to the second position is performed by an operation for displacing the feed roller unit 50 from the non-feed position to the feed position, an actuator for displacing the restricting member 70 from the first position to the second position is not separately needed. Therefore, the number of components also does not need to be increased.

(5) In general, if there is warping or a wrinkle on the paper sheet P set in the paper feed tray 16 and the paper sheet P is thus deformed, the first detection lever 20 may not sufficiently receive pressure from the paper sheet P and the first detection lever 20 may not retract into the paper feed tray 16 despite the existence of the paper sheet P in the paper feed tray 16. Further, in this case, an OFF-detection signal is input to the control unit 80 from the paper sheet detecting sensor 22. Accordingly, there is a false detection that the paper sheet P does not exist in the paper feed tray 16. In this regard, in this embodiment, if an OFF-detection signal is input to the control unit 80 from the paper sheet detecting sensor 22 when the feed roller unit 50 is displaced from the non-feed position to the feed position and the feed roller unit 50 is positioned at the feed position, the control unit 80 determines that a paper sheet P does not actually exist in the paper feed tray 16 and then displaces the feed roller unit 50 from the feed position to the non-feed position. That is, when the feed roller unit 50 is positioned at the feed position, the paper sheet P set in the paper feed tray 16 is pressed from above by the feed roller unit 50. Accordingly, even though the paper sheet P is deformed, the first detection lever 20 reliably and sufficiently receives pressure from the paper sheet P. If an OFF-detection signal is input to the control unit 80 from the paper sheet detecting sensor 22 in this state, the control unit 80 determines that a paper sheet P does not actually exist in the paper feed tray 16 and then displaces the feed roller unit 50 from the feed position to the non-feed position. Accordingly, it may be possible to reliably avoid that an OFF-detection signal is input to the control unit 80 from the paper sheet detecting sensor 22 despite the existence of the following paper sheet P in the paper feed tray 16. As a result, it may be possible to reliably detect whether the paper sheet P set in the paper feed tray 16 exists or not.

(6) The first detection lever 20 of the paper sheet detecting sensor 22 is disposed near a position where the feed roller unit 50 can come in contact with the set face 16*a* when being displaced to the feed position. For this reason, even though the paper sheet P set on the set face 16*a* is deformed, the paper sheet P is pressed from above by the feed roller unit 50 when the feed roller unit 50 is displaced to the feed position. Accordingly, the first detection lever 20 reliably and sufficiently receives pressure from the paper sheet P. As a result, it may be possible to reliably and accurately detect by the paper sheet detecting sensor 22 whether the paper sheet P set on the set face 16*a* exists or not.

(Modification)

Meanwhile, the above-mentioned embodiment may be modified as follows:

The first detection lever 20 of the paper sheet detecting sensor 22 does not need to be necessarily disposed near a position where the feed roller unit 50 can come in contact with the set face 16*a* when being displaced to the feed position. That is, as long as the first detection lever 20 can detects the paper sheet P set on the set face 16*a*, the first detection lever may be disposed at any position on the set face 16*a*. However, in this case, it is necessary to avoid the first detection lever being disposed at a position where engagement with the feed roller unit 50 is caused when the feed roller unit 50 is displaced to the feed position.

As for the routine for transporting the paper sheet, the control unit 80 may terminate the routine for transporting the paper sheet if the determination result of Step S1 corresponds to a negative determination. In addition, Step S6-1 for determining whether an ON-detection signal is input to the control unit 80 from the paper sheet detecting sensor 22 may be interposed between Steps S6 and S7. The control unit 80 may make the process proceed to Step S2 if the determination result of Step S6-1 corresponds to a positive determination, and makes the process proceed to Step S7 if the determination result of Step S6-1 corresponds to a negative determination. Steps S3 and S10 may be omitted in this case. Accordingly, when Steps S3 and S10 are omitted, the control unit 80 performs Step S5 after performing Step S2 and then performs Step S4, and performs Step S11 after performing Step S9.

A plastic film may be used as a sheet instead of a paper sheet P.

In addition, the scope, which may be obtained from the above-mentioned embodiment, will be described below.

(A) There is a provided a method of detecting a sheet in a transport device. The transport device includes a set section, a sheet sensor, and a feeding member. The set section includes a set face on which sheets can be set in a stacked state. When a detection member, which is provided on the set face of the set section so as to freely extend back and forth from the lower side, receives pressure from the sheet set in the set section and retracts, the sheet sensor outputs an ON-detection signal. When the detection member does not retract, the sheet sensor outputs an OFF-detection signal. The feeding member is transferred between a feed position and a non-feed position on the basis of the detection signal output from the sheet sensor. At the feed position, the feeding member comes in contact with the sheet set in the set section from above and feeds the sheet toward the downstream side on the transport path. At the non-feed position, the feeding member is separated upward from the feed position. The method of detecting a sheet includes displacing the feeding member from the feed position to the non-feed position and then displacing the feeding member to the feed position again when an OFF-detection signal is output from the sheet sensor after the feeding member has been displaced to the feed position on the basis of an ON-detection signal output from the sheet sensor and sheets have begun to be fed, and detecting that the sheet does not exist in the set section when an OFF-detection signal is output from the sheet sensor again while the feeding member is positioned at the feed position.

(B) There is a provided a transport device. The transport device includes a set section, a sheet sensor, a feeding member, and a controller. The set section includes a set face on which sheets can be set in a stacked state. The sheet sensor outputs an ON-detection signal when a detection member receives pressure from the sheet set in the set section and retracts, and outputs an OFF-detection signal when the detection member does not retract. The detection member is provided on the set face of the set section so as to freely extend back and forth from the lower side. The feeding member is displaced between a feed position and a non-feed position. At the feed position, the feeding member comes in contact with the sheet set in the set section from above and feeds the sheet toward the downstream side on the transport path. At the non-feed position, the feeding member is separated upward from the feed position. The controller controls a displacing operation of the feeding member on the basis of the detection signal output from the sheet sensor. The controller displaces the feeding member from the feed position to the non-feed position and then displacing the feeding member to the feed position again when an OFF-detection signal is output from the sheet sensor after the feeding member has been displaced to the feed position on the basis of an ON-detection signal output from the sheet sensor and the sheets have begun to be fed, and displaces the feeding member from the feed position to the non-feed position when an OFF-detection signal is output from the sheet sensor again while the feeding member is positioned at the feed position.

What is claimed is:

1. A method of detecting a sheet in a transport device, the transport device including a set section that includes a set face on which a sheet is set, a sheet sensor that outputs an ON-detection signal when a detection member, which is provided on the set face of the set section so as to freely extend back and forth from the lower side, receives pressure from the sheet set in the set section and retracts and outputs an OFF-detection signal when the detection member does not retract, and a feeding member that is displaced between a feed position where the feeding member comes in contact with the sheet set in the set section from above and feeds the sheet toward the downstream side on a transport path and a non-feed position where the feeding member is separated upward from the feed position, on the basis of the detection signal output from the sheet sensor, the method comprising:

after driving a feeding motor of the feeding member in the normal direction and displacing the feeding member from the non-feed position to the feed position after an OFF-detection is input from the detection member, determining whether an ON-detection signal is subsequently input from the detection member;

driving the feeding motor of the feeding member in a reverse direction while the feeding member is in the feed position if an OFF-detection signal is input from the detection member after driving the feeding motor in the normal direction after the OFF-detection is input from the detection member.

2. A transport device comprising:

a set section that includes a set face on which a sheet is set;

a sheet sensor that outputs an ON-detection signal when a detection member receives pressure from the sheet set in the set section and retracts, and outputs an OFF-detection signal when the detection member does not retract, the detection member being provided on the set face of the set section so as to freely extend back and forth from the lower side;

a feeding member that is displaced between a feed position where the feeding member comes in contact with the sheet set in the set section from above and feeds the sheet toward the downstream side on a transport path and a non-feed position where the feeding member is separated upward from the feed position; and a controller that controls a displacing operation of the feeding member on the basis of the detection signal output from the sheet sensor, wherein, after driving a feeding motor of the feeding member in the normal direction and displacing the feeding member from the non-feed position to the feed position in response to an OFF-detection signal being input from the paper detecting sensor, the controller determines whether an ON-detection signal is subsequently input from the paper sheet detecting sensor, and after driving the feeding motor in the normal direction if an OFF-detection signal is input from the detection member the feeding motor drives the feeding member in a reverse direction while the feeding member is in the feed position.

3. The transport device according to claim 2, wherein the detection member of the sheet sensor is disposed near a position where the feeding member comes in contact with the set face when the feeding member is displaced to the feed position.

4. An image reading device comprising:

the transport device according to claim 3; and a reading unit that reads an image recorded on the sheet transported by the transport device.

5. An image reading device comprising:

the transport device according to claim 2; and a reading unit that reads an image recorded on the sheet transported by the transport device.

6. An image forming apparatus comprising:

the image reading device according to claim 5; and a recording unit that records an image read by the image reading device.

* * * * *